United States Patent [19]

Ito et al.

[11] Patent Number: 4,809,762

[45] Date of Patent: Mar. 7, 1989

[54] METHOD OF CASTING A COMPOSITE METAL ARTICLE

[75] Inventors: Hiroshi Ito; Terumi Nagao; Toshiki Takeda; Yohikuni Maruyama, all of Saitama; Toshitake Kanno, Shizuoka, all of Japan

[73] Assignee: Honda Giken Kogyo Kabushiki Kaisha, Tokyo, Japan

[21] Appl. No.: 79,096

[22] Filed: Jul. 29, 1987

[30] Foreign Application Priority Data

Jul. 29, 1986 [JP] Japan ..... 61-178452
Jul. 29, 1986 [JP] Japan ..... 61-178453

[51] Int. Cl.[4] ..... B22C 9/04; B22D 19/06

[52] U.S. Cl. ..... 164/9; 164/34; 164/53; 164/105

[58] Field of Search ..... 164/54, 9, 10, 11, 34, 164/35, 53, 105, 103, 104

[56] References Cited

U.S. PATENT DOCUMENTS 3,396,776 8/1968 Funk ..... 164/54
3,933,191 1/1976 Adams et al. ..... 164/54

FOREIGN PATENT DOCUMENTS 2658491 6/1978 Fed. Rep. of Germany ..... 164/105
56-148441 11/1981 Japan ..... 164/54

*Primary Examiner*—Nicholas P. Godici
*Assistant Examiner*—J. Reed Batten, Jr.
*Attorney, Agent, or Firm*—Irving M. Weiner; Joseph P. Carrier; Pamela S. Burt

[57] ABSTRACT

A cast-in member and a heating member are set in a mold with the cast-in member being in the vicinity of the heating member. Molten metal is poured through an ignition runner into contact with the heating member to ignite the latter and produce heat. The cast-in member is heated with the heat from the heating member. Thereafter, molten metal is poured through a runner into a cavity in the mold to cast the metal around the cast-in member.

7 Claims, 5 Drawing Sheets

METHOD OF CASTING A COMPOSITE METAL ARTICLE

BACKGROUND OF THE INVENTION

1. Field of the Invention

The present invention relates to a method of casting iron around a highly hard steel member and a mold for carrying out such a method.

2. Description of the Relevant Art:

Trimming dies are known as devices for cutting off a workpiece such as an iron sheet or the like to a prescribed shape. The trimming dies generally include a lower die and an upper die movable toward and away from the lower die. The upper die is lowered toward the lower die, and while holding the workpiece against the lower die with a pad mounted on the upper die, the workpiece is severed to the desired shape by cutters on the upper and lower dies.

Since the cutters of the trimming dies are forcibly driven to sandwich and cut off the workpiece vertically, they are required to be made of highly hard steel material such as high carbon steel. The trimming dies, on the other hand, should preferably be made of cast iron which is inexpensive and tough in view of the cost of manufacture and machinability after the casting process.

There is known a method of manufacturing a composite product, such as trimming dies as described above, which is made of two metals having different physical properties such as hardness and toughness. According to this known method, after a trimming die has been manufactured by casting, a cutter is formed by padding or inserting on the die. However, the efficiency and cost of production are low because the cutter must be formed by a separate process after the die has been cast.

As a solution to the above shortcoming, a single process of manufacturing a composite product is known as disclosed in Japanese Laid-Open Patent Publication No. 57-25276.

According to the disclosed method, as shown in FIG. 11 of the accompanying drawings, a mold cavity 201 for molding a trimming die is defined in a mold 200 having separate runners 202, 203 communicating with the mold cavity 201. The mold cavity 201 is supplied with a molten mass of ordinary iron 205 through the runner 203 and with a molten mass of highly hard steel 204 for integrally casting a trimming die of materials having different material properties.

Where molten masses of materials of different natures are introduced into the mold cavity through the respective runners, a process known as two-layer casting, the different materials must be heat-treated in different manners after they have been cast. More specifically, the highly hard steel must be heat-treated at a higher temperature than the temperature at which the oridinary iron is heat-treated. However, it is difficult to heat-treat the different sections of the cast product under different temperature conditions. If the different sections were heat-treated differently, the cast-iron product portion would tend to have an undesired metal structure, resulting in material deterioration.

Another conventional process for making a composite product is known as a full mold process. In the full mold process, a pattern of a material such as foamed polystyrene which will evaporate upon heating and a member of highly hard steel to be cast in are set in a mold, and molten metal such as iron is poured into the mold to cause the pattern to evaporate, whereupon the molten iron is cast around the steel member.

If the heat mass of the steel member is large, then the steel member and the molten iron will not adhere well to each other. A method for eliminating this drawback is proposed in Japanese Patent Publication No. 49-7299.

FIG. 12 of the accompanying drawings shows such a proposed method. A member 301 of highly hard steel to be cast in is set in a mold cavity 302 defined in a mold 300, and a heating member 303 is disposed in the mold 300 so as to extend across the member 301 and the mold cavity 302. Molten iron poured through a sprue 304 into the mold cavity 302 is brought into contact with the heating member 303 which is then ignited and burned. The temperature of the member 301 is increased by the heat generated when the heating member 303 is burned, so that the member 301 and a main product portion formed by the molten iron will adhere well to each other. A gas that is given off when the heating member 303 is burned is discharged through a gas release hole 305.

With this method, however, the molten iron introduced into the mold cavity 302 contacts the member 301 before the temperature of the member 301 is increased, thus allowing the temperature of the molten iron at the confronting surface of the member 301 to drop sharply. As a result, a solidified film is formed at the interface between the member 301 and the product portion formed by the molten iron, resulting in a low mechanical strength of the interface. Moreover, inasmuch as the molten iron and the heating member are in direct contact with each other, they stick to each other due to burn-on, and the cast product cannot easily be removed from the mold.

When a loop-shaped member to be cast in is set in the mold and then molten iron is poured into the mold, the loop-shaped member will be expanded radially due to the heat of the molten iron and thereafter will shrink. Since the loop-shaped member which is made of highly hard steel is forced to shrink while being surrounded by the main product portion formed by the molten iron, the loop-shaped member tends to suffer from residual stresses which will be responsible for possible strains in the cast product.

SUMMARY OF THE INVENTION

It is an object of the present invention to provide a method of casting iron around a member while allowing the molten iron and the member to adhere securely to each other and preventing strains from being produced in the member, so that a resultant composite product will have high mechanical strength and be of a well shaped overall profile.

According to the present invention, there is provided a method of casting metal around a cast-in member, comprising the steps of setting the cast-in member and a heating member in a mold with at least a portion of the cast-in member being held in contact with the heating member, pouring molten metal through an ignition runner into contact with the heating member to ignite the latter and produce heat, heating the cast-in member with the heat from the heating member, and thereafter pouring molten metal through a runner into a cavity in the mold to cast the metal around the cast-in member.

The heating member contacting the cast-in member in the mold is ignited by the molten metal, and the cast-in member is well heated. As a result, any difference between the temperature of the cast-in member and the temperature of the molten metal poured into the cavity is reduced. Thus, no solidified film is formed between the molten metal and the cast-in member, or any solidified film formed therebetween will be re-dissolved, so that a main product portion formed by the molten metal and the cast-in member will adhere well to each other.

By isolating the heating member from the molten metal in the mold cavity and from the cast-in member by a shield layer, the metallic materials of the heating member are prevented from being melted by the heat of such molten metal and the heating member, and hence the heating member and the cast product are prevented from sticking to each other by burn-on.

A loop-shaped cutter to be cast in a main product body is divided longitudinally into at least two members. When molten metal is poured into the mold cavity in which the cutter is set, the cutter is expanded longitudinally by the heat of the molten metal, but such an expansion is absorbed by the gaps between the cutter members. The cutter is therefore prevented from being displaced or deformed transversely, and can be cast in the position in which it has been set. The confronting ends of the cutter members are coupled by guide members which allow them to move only longitudinally for allowign the cutter to remain in position without transverse deformation and deviation of the confronting ends.

The above and further objects, details and advantages of the present invention will become apparent from the following detailed description of preferred embodiments thereof, when read in conjunction with the accompanying drawings.

DETAILED DESCRIPTION OF THE PREFERRED EMBODIMENT

Figure 1:
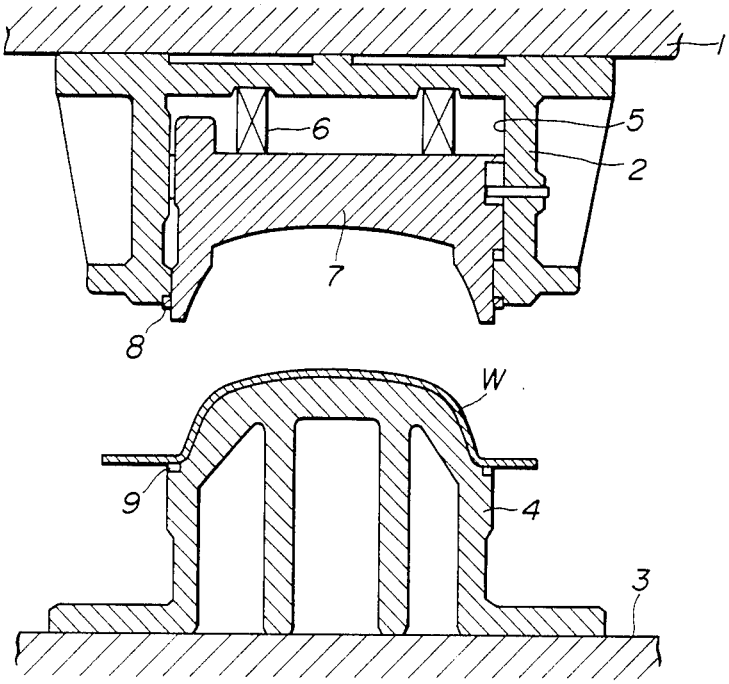
FIG. 1 is a cross-sectional view of trimming dies cast according to a method of the present invention.
Figure 2:
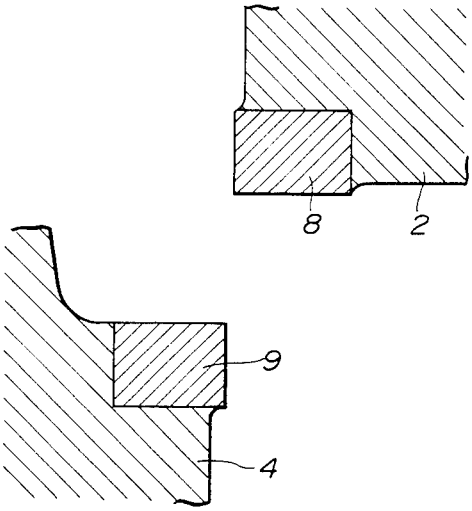
FIG. 2 is an enlarged fragmentary cross-sectional view of the trimming dies shown in FIG. 1.

As shown in FIGS. 1 and 2, trimming dies include an upper die 2 fixed to a vertically movable member 1 such as a ram and a lower die 4 fixed to a floor 3. The upper die 2 has a central recess 5 opening downwardly and accommodating therein a workpiece presser pad 7 normally urged to move downwardly under the resilient force of a spring 6. Cutters 8, 9 are mounted on lower inner and upper outer peripheral surfaces of the upper and lower dies 2, 4, respectively. The cutters 8, 9 are made of a highly hard material such as high carbon steel, for exmaple, and cast in the mass of cast iron of the upper and lower dies 2, 4. A workpiece W such as a metal sheet is shown on top of the lower die 4 in FIG. 1.

A process of casting iron around the cutter 8 will be described below with reference to FIGS. 3 and 4.

Figure 3:
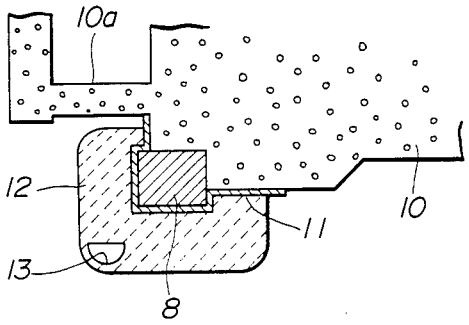
FIGS. 3 and 4 are fragmentary cross-sectional views showing sequential steps of the method of the present invention.

As shown in FIG. 3, a pattern 10 identical in shape to the upper die 2 to be cast is made of foamed polystyrene or the like which can be dissolved and evaporated by the heat of molten metal such as iron. The cutter 8, or a cast-in member or insert is attached to the pattern 10 at a prescribed position, and outer exposed sides of the cutter 8 are covered with a shield layer 11. The shield layer 11 has a thickness in the range of from 2 to 10 mm, and is made of carbon powder, particles of which are held together by a binder such as furan resin, for example.

Then, a heating member 12 is set around the cutter 8 covered with the shield layer 11. The heating member 12 is made of 30 to 35 weight % of aluminum, 15 to 20 weight % of an oxidizing agent (such as FeO or MnO), 1 to 5 weight % of a binder (furan resin), and 0.5 to 3 weight % of a hardener.

The pattern 10 includes an integral portion **10*a* which will serve as a pouring runner when molten iron is poured. The heating member 12 has a runner 13 for igniting the heating member 12**.

Thereafter, the assembly of the pattern 10, the cutter 8, the shield layer 11, and the heating member 12 is set in a frame 14 as shown in FIG. 14, and a refractory material 15 such as sand including a binder is placed in the frame 14 around the assembly, thus forming a mold.

Figure 4:
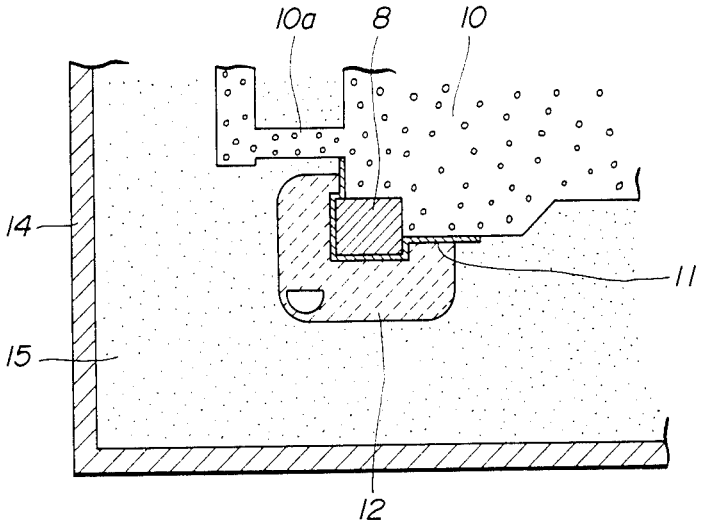
Figure 5:
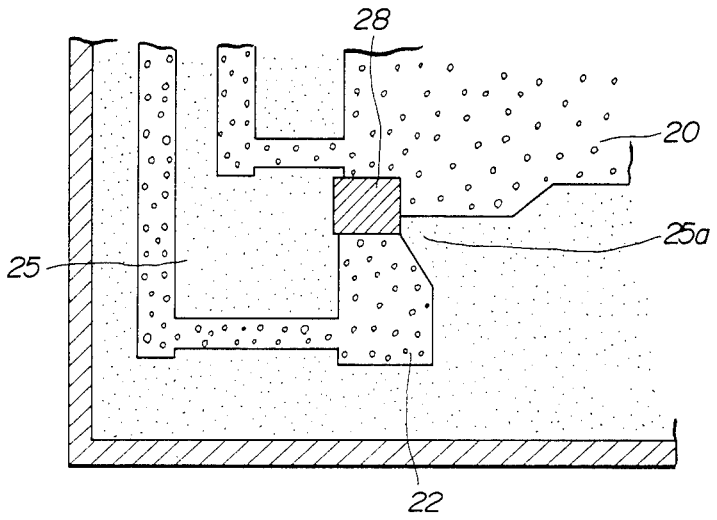
FIGS. 5 and 6 are fragmentary cross-sectional views showing another method of the present invention for comparison with the method as shown in FIGS. 3 and 4.
Figure 6:
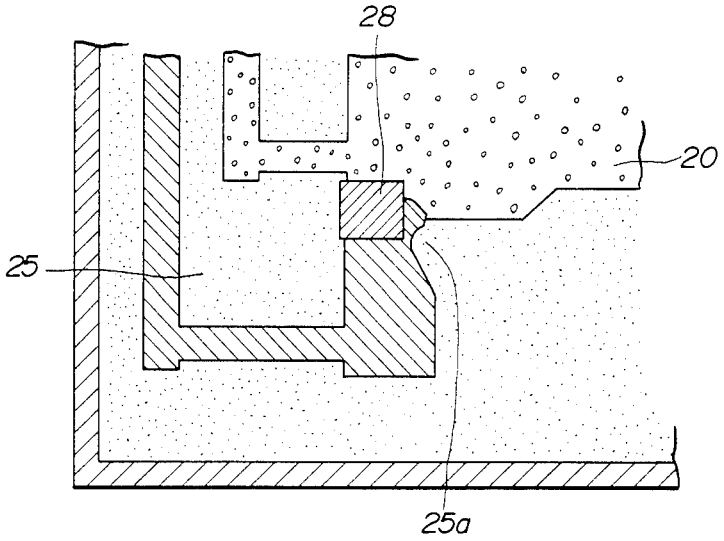

FIG. 5 shows another process/arrangement of the present invention which will be compared with the process/arrangement of FIGS. 3–4. In the comparative arrangement no shield layer is employed and a member 28 to be cast in is attached to a pattern 20 of foamed resin. A preheating member 22 of foamed resin is held in contact with a portion of the member 28. The pattern 20, the member 28, and the preheating member 22 are surrounded by sand 25 thereby to form a mold. First, molten iron is poured into the preheating member 22 to increase the temperature of the member 28. Upon elapse of a certain period of time, molten iron is poured into the pattern 20. Since a main product portion which is made of the molten iron poured into the pattern 20 is brought into contact with the member 28 which has been well heated by the molten iron supplied to the preheating member 22, the main product portion can adhere well to the member 28. However, if the sand mold 25 has a thin portion 25a between the preheating member 22 and the pattern 20, as shown in FIG. 6, the thin portion **25*a* may be ruptured by the molten iron poured into the preheating member 22, allowing the molten iron to flow into the pattern 20 and stick to the member 28. Where the member 28 has a three-dimensional shape, in particular, the above problem manifests itself at a low position on the member 28**.

Referring again to FIGS. 3–4, after the assembly of the pattern 10, the cutter 8, the shield layer 11, and the heating member 12 has been set in place in the mold, molten metal is poured into the heating member 12 through the runner 13 to ignite the heating member 12. In about 1 minute after the heating member has been ignited, the heating member 12 is heated up to a temperature ranging from 1,500° to 1,800° C. The heat of the heating member 12 is transmitted through the shield layer 11 to the cutter 8, thereby heating the junction or interface between the cutter 8 and the molten metal up to a temperature ranging from 600° to 800° C.

After the cutter 8 has been sufficiently heated, molten iron is poured into the portion 10*a* of the pattern 10, which is now evaporated due to the heat of the molten iron and replaced with the molten iron that is cast around the cutter 8.

Then, the cast product or upper die 2 is removed from the mold by shake-out, and the heating member 12 is detached from the cutter 8. The cast iron at the portion 10*a* is removed from the upper die 2 thus produced. The upper die 2 is cast in the foregoing manner. The lower die 4 is cast in a similar fashion.

While in the above embodiment the entire exposed surface of the cutter 8 on the pattern 10 is covered with the shield layer 11 to prevent the heating member 12 from contacting the cutter 8, only a portion of the cutter 8 may be covered with the shield layer 11. The cutter 8 to be cast in is shown as being attached to the pattern 10 and surrounded by the sand mold. However, the pattern which will evaporate upon pouring of molten iron may be dispensed with, and the cutter 8 may be set directly in the cavity of a mold.

With the above arrangement of the present invention, the heating member has the runner for igniting the heating member itself, and molten iron is poured into the heating member before molten iron is poured into the pattern or the mold cavity. Therefore, the molten metal which will form a main product portion is brought into contact with the cutter only after the cutter has been well heated. The cutter and the main product portion are thus allowed to adhere well to each other, and the cast product has a high degree of mechanical strength.

With the shield layer interposed between the heating member and the molten metal in the mold cavity and the cutter, the metallic materials of the heating member are prevented from being melted by the heat of such a molten metal and the heating member and hence from sticking to the surface of the cutter due to burn-on with the heat of the heating member. As a consequence, the cast product can be easily removed from the mold. Where the shield layer is disposed at a relatively fragile portion of the heating member which contacts the cutter, the cutter will not be displaced in position when pouring the molten iron.

Another embodiment of a trimming die will be described with reference to FIGS. 7 through 9.

Figure 7:
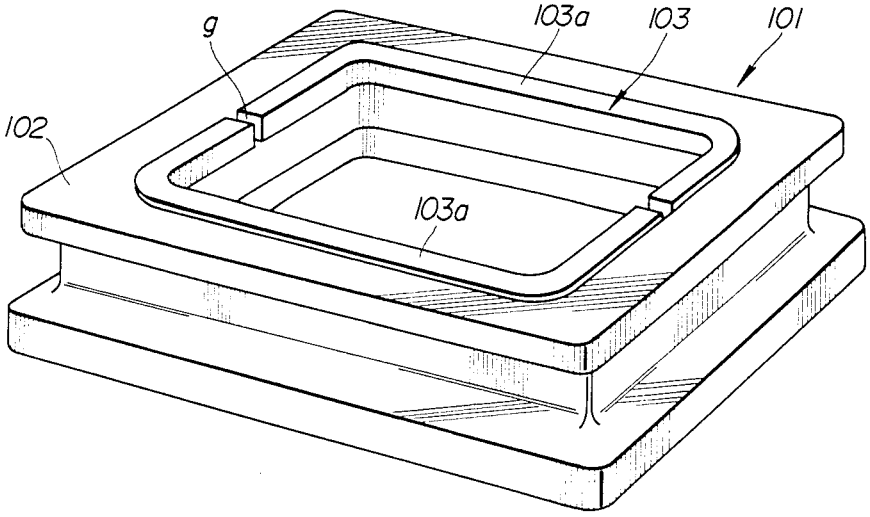
FIG. 7 is a perspective view of a lower trimming die produced by the method of the invention.
Figure 8:
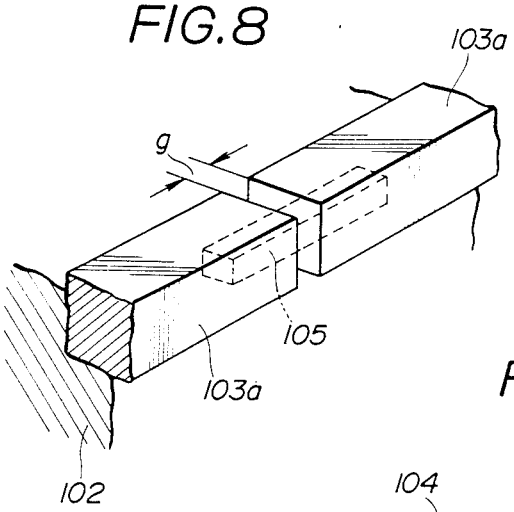
FIG. 8 is an enlarged fragmentary perspective view of the lower trimming die shown in FIG. 7.

An upper die (not shown) is vertically movably disposed above a lower die 101 (FIG. 7). The lower die 101 comprises a main body 102 and a cutter 103 integrally cast with the main body 102. The cutter 103 is loop-shaped and constructed of two separate members 103*a*. As illustrated in FIG. 8, the cutter members 103*a* have confronting ends spaced from each other by a gap g which should preferably be smaller than the thickness of a workpiece to be cut off by the cutter 103.

Figure 9:
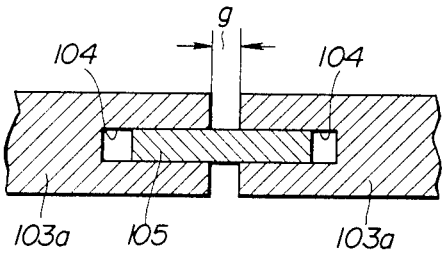
FIG. 9 is an enlarged cross-sectional view of the lower trimming die shown in FIG. 7.

As shown in FIG. 9, the confronting ends of the cutter members 103*a* have longitudinal recesses 104 opening toward each other, and a guide member 105 is inserted in the recesses 104. The guide member 105 serves to prevent the confronting ends of the cutter members 103*a* from being displaced transversely while allowing them to move longitudinally.

Figure 10:
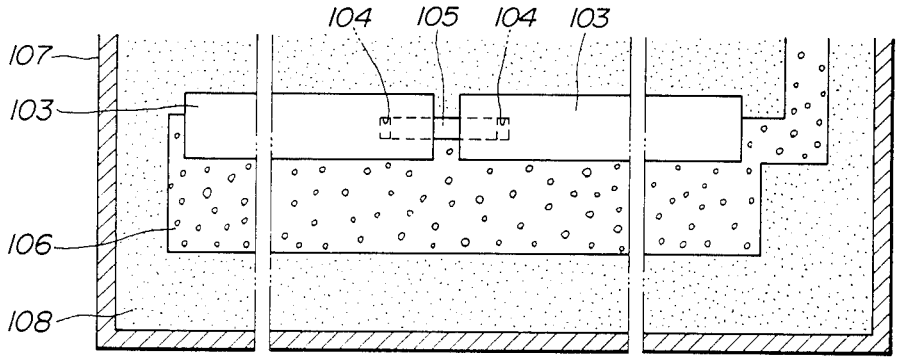
FIG. 10 is a fragmentary cross-sectional view showing a process of casting the lower trimming die.
Figure 11:
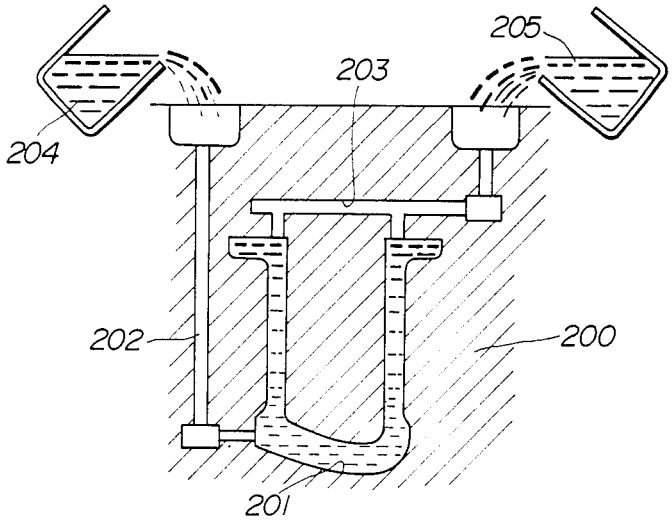
FIG. 11 (PRIOR ART)
FIG. 11 is a cross-sectional view showing a conventional method.
Figure 12:
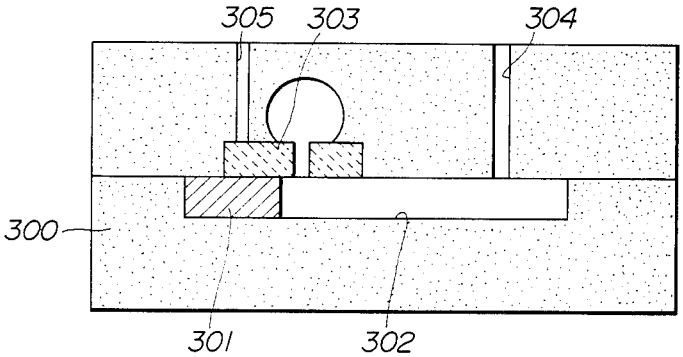
FIG. 12 (PRIOR ART)
FIG. 12 is a cross-sectional view showing another conventional method.

A process of casting the lower die 101 will be described with reference to FIG. 10. A pattern 106 which is identical in shape to the main body 102 is prepared. The pattern 106 is made of a material such as foamed resin which will be evaporated by the heat of molten iron poured thereinto. The cutter 103, which is made of highly hard steel, is attached to the pattern 106. The pattern 106 with the cutter 103 attached is set in a frame 107, and a refractory material 108 such as sand including a binder is introduced into the frame 107 around the pattern 106 and the cutter 103.

Then, molten iron is supplied to the pattern 106, which is evaporated thereby and replcaed with the molten iron which is cast around the cutter 103.

In order to increase the mechanical strength with which the cutter 103 and the main body 102 of the die 101 adhere to each other, it is preferable that a heating member or an evaporatable preheating member be held in contact with a portion of the cutter 103 which is out of contact with the pattern 106, and that such a heating member or evaporatable preheating member be supplied with molten iron through a separate runner before the pattern 106 is supplied with its own molten iron, to thereby increase the temperature of the cutter 103 prior to introduction of molten iron via the pattern 106 into contact with the cutter 103.

When molten iron is supplied to the pattern 106, the temperature of the cutter 103 is increased upon contact with the molten iron poured via the pattern 106. Since the confronting ends of the cutter members 103*a* are spaced from each other by the gap g and movable longitudinally away from and toward each other by the guide member 105, the cutter 103 expands almost only in the longitudinal direction and is not displaced in position in the transverse direction.

The cutter 103 may be divided into three separate members.

With the above construction of the trimming die, the cutter comprises a plurality of separate cutter members with gaps therebetween and guide members interconnecting the cutter members while allowing longitudinal movement. Therefore, even when the cutter is expanded by the heat of molten iron supplied to cast the trimming die, such expansion is longitudially absorbed by the gaps, and the cutter is prevented from being deformed transversely. The cutter thus cast in the main body of the trimming die is therefore of a well shaped profile.

Although there have been described what are at present considered to be the preferred embodiments of the present invention, it will be understood that the invention may be embodied in other specific forms without departing from the spirit or essential characteristics thereof. The present embodiments are therefore to be considered in all aspects as illustrative, and not restrictive. The scope of the invention is indicated by the appended claims rather than by the foregoing description.

We claim:

1. A method of casting metal around a cast-in member, comprising the steps of:

setting the cast-in member and a heating member in a mold with said cast-in member being in the vicinity of said heating member;

pouring molten metal through an ignition runner into contact with said heating member to ignite the latter and produce heat;

heating said cast-in member with the heat from said heating member; and thereafter pouring molten metal through a runner into a cavity in the mold to cast the metal around said cast-in member.

2. A method according to claim 1, wherein said cast-in member is entirely of a loop shape and comprises a plurality of separate members divided along the loop shape, said separate members having confronting ends spaced from each other by small gaps, said heating member being held in contact with at least a portion of each of said separate members of the cast-in member.

3. A method according to claim 2, wherein said cast-in member has a guide member, said confronting ends of said separate members having longitudinal recesses defined respectively therein, said guide member being inserted in said recesses and coupling said confrontingends so as to be movable only longitudinally.

4. A method according to claim 1, wherein said cast-in member is made of steel and said molten metal is iron.

5. A method according to claim 1, wherein said method comprises the additional step of setting a pattern in the mold to define a space which the molten metal will subsequently occupy, said pattern being evaporable by the heat of the molten metal when the molten metal is subsequently poured into the mold cavity.

6. A method according to claim 5, further including the additional step of providing a shield layer to isolate said pattern and said heating member from each other.

7. A method according to claim 6, wherein said shield layer is also interposed between said heating member and said cast-in member for controlling the amount of heat transferred from said heating member to said cast-in member.

* * * * *

UNITED STATES PATENT AND TRADEMARK OFFICE

CERTIFICATE OF CORRECTION

PATENT NO. : 4,809,762

DATED : March 7, 1989

INVENTOR(S) : Hiroshi ITO et al.

It is certified that error appears in the above-identified patent and that said Letters Patent is hereby corrected as shown below:

On the title page, after "Kanno" in the Inventors designation insert --and Ikuo Ichino--.

Signed and Sealed this

Fourteenth Day of May, 1991

*Attest:*

*Attesting Officer*

HARRY F. MANBECK, JR.

*Commissioner of Patents and Trademarks*